US006433805B1

(12) United States Patent
Snelling

(10) Patent No.: US 6,433,805 B1
(45) Date of Patent: Aug. 13, 2002

(54) COLOR PRINTING SYSTEM

(75) Inventor: Christopher Snelling, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/451,049

(22) Filed: Nov. 30, 1999

Related U.S. Application Data

(63) Continuation of application No. 08/499,530, filed on Jul. 7, 1995, now abandoned.

(51) Int. Cl.[7] ..... B41S 2/385; G03G 9/08
(52) U.S. Cl. ..... 347/156
(58) Field of Search ..... 347/151, 120, 347/141, 154, 103, 123, 111, 159, 127, 128, 131, 125, 158, 156; 430/42, 45

(56) References Cited

U.S. PATENT DOCUMENTS

| | | | |
|---|---|---|---|
| 3,900,318 | A | 8/1975 | Zographos et al. |
| 4,081,277 | A | 3/1978 | Brault |
| 4,121,932 | A | 10/1978 | Ishida |
| 4,124,384 | A | 11/1978 | Centa |
| 4,230,784 | A | 10/1980 | Nishiguchi et al. |
| 4,238,562 | A | 12/1980 | Ishida et al. |
| 4,251,611 | A | 2/1981 | Mehl et al. |
| 4,262,078 | A | 4/1981 | Ishida et al. |
| 4,456,669 | A | 6/1984 | Yubakami et al. |
| 4,463,363 | A | 7/1984 | Gundlach et al. |
| 4,619,515 | A | 10/1986 | Maczuszenko et al. |
| 4,777,904 | A | 10/1988 | Gundlach et al. |

FOREIGN PATENT DOCUMENTS

| | | |
|---|---|---|
| JP | 60 250360 | 11/1985 |
| JP | 01 195092 | 4/1989 |
| JP | 04 101882 | 3/1992 |
| JP | 05 061255 | 12/1993 |

*Primary Examiner*—Raquel Yvette Gordon
(74) *Attorney, Agent, or Firm*—Lloyd F. Bean, II

(57) ABSTRACT

A printing machine is disclosed, that combines charged image pattern creation techniques of electrostatic imaging with the coloration capabilities of dye sublation to produce novel color printing systems offering unique advantages in copy quality, costs, speed, and security. Donor particles having a sublimable dye coated thereon are employed with electrostatic imaging techniques to create a temporary donor image. Uniform heat is applied to sublime dyes from the donor particle pattern into the final image support member.

8 Claims, 1 Drawing Sheet

COLOR PRINTING SYSTEM

INCORPORATION BY REFERENCE

This case is a continuation in part of patent application Ser. No. 08/499,530, (D/92697). filed Jul. 7, 1996 and abandoned

FIELD OF THE INVENTION

The invention relates generally to a color-printing machine and more specifically, to a color printing machine employing dye diffusion electrography.

BACKGROUND OF THE INVENTION

Dye sublimation based marking systems are emerging as real contenders in the high quality color printer marketplace. Existing commercial products typically use a thermal printhead to selectively sublime dyes from donor ribbons into a polymer coated receiving sheet. This process which has been named Dye Diffusion Thermal Transfer, hereinafter (D2T2), produces near photographic quality prints and transparencies due in part to the color purity and color mixing properties of dyes.

In the process, a thermal head is used to transfer dye from a color ribbon onto a receiver paper. The thermal head consist of a number of resistive elements deposited by a thin film process onto an alumina substrate and arranged in a linear array. Each approximately square element is split at right angles to the direction of the array (in order to minimize visible structure in the print), and is independently addressable by virtue of multiple input lines and logic circuitry on the head. Printing is carried out by energizing the head with data corresponding to the image while driving a color ribbon and receiver paper under the head, thus writing the entire image during a single pass. The quantity of dye transferred, and thus the intensity of color generated at each image point, is controlled by the temperature at the ribbon/receiver interface. By adjusting the on-time of each element in the head during printing, a continuous tone image is produced. Full color is achieved by overprinting entire fields of the three subtractive primary colors: yellow, magenta, and cyan.

There are several disadvantages with D2T2, including slow process speed, cost per copy, and security. The process speed of D2T2 is limited due to achievable dye diffusion rates which creates high energy demands on the thermal printhead. The cost per copy is high because of the consumption of dye coated donor ribbons and the special polymer coated paper requirement. In addition to posing a potential security "leak" because they retain mirror images of printed material, used donor films present the user of D2T2 systems with the problem of dye-film disposal in our increasingly sensitive "ever green" environment.

In response to these problems, a need exists for an alternative color printing process that can retain the high quality dye coloration advantages of D2T2, while achieving a significant reduction in problems associated therewith.

The following disclosure may be relevant to some aspect of the present invention.

In U.S. Pat. No. 3,900,318 to Zographos et al., a process is disclosed which involved the use of sublimable dispersed dyes in photoelectrophoretic image reproduction. The dispersed dyes can be converted into the vapor phase at temperatures of between 160° and 220° C under atmospheric pressure. In this imaging process, the dye-containing particles themselves are the photoreceptors.

U.S. Pat. No. 4,251,611 to Mehl et al., discloses a process for the information of a permanent image in which one or more colors from a latent electrostatic image which correspond to the color separations of an original are developed by means of a developer composed of polymer particles containing a dyestuff which can sublime or polymer particles containing a dyestuff which can sublime or vaporize at between 100° and 250°C. Latent images are developed on a photoconducting element by means of a developer containing, in addition to the dyestuff, a ferromagnetic substance incorporated into the polymer particles. Each image thus developed is brought into contact with a receiving sheet which possesses an affinity for the vapors of the sublimable or vaporizable dyestuff of the developers. Next, the resulting material is heated above the vaporization or sublimation temperature of the dyestuff to be transferred. These steps are carried out in the case of each latent image, until the image to be reproduced has been recomposed. This process can effectively destroy the photoreceptor and is not suitable for use in a plain paper xerographic application.

U.S. Pat. No. 4,262,078 to Ishida et al., discloses a light transmitting particle containing a sublimable color-former which is a pyridine derivative suitable for use in the formation of a color image. The process of Ishida et al. uses the light transmitting characteristics of the particle to form an image.

U.S. Pat. No. 4,238,562 to Ishida et al., discloses a light transmission particle for forming a color image. The particle contains a sublimable dye that is a spirobenzopyran indole compound suitable for use in the formation of a color image. The process disclosed in Ishida et al. is similar to that of U.S. Pat. No. 4,262,078, in that the process uses the light transmitting characteristics of the particle to form the image.

U.S. Pat. No. 4,230,784, issued to Nishiguchi et al., discloses imageforming particles for use in electrostatic image production. These particles have a light transmitting property and comprise an electrically conductive material and a subliming substance. In the process of Nishiguchi et al., an image is formed by directly exposing tile toner.

U.S. Pat. No. 4,124,384 to Centa, discloses an image reproduction process is disclosed which uses a photohardenable element containing photohardenable layers toned with a toner material comprising a sublimable dye. The process involves heating the above-stated toned layer while in contact with a receptor material, therefore causing the dye to sublime imagewise and condense on the receptor material. The receptor comprises polymer organic compounds.

U.S. Pat. No. 4,456,669 to Yubakami et al., discloses an image forming process disclosed utilizing heat-transferable dyes to form images on a receiving substrate. Images signals are used to arrange image forming particles on a support member. The particles contain a dye former which is heat-transferred onto an image receiving substrate. After heating, a color developing agent is used to adhere to the dye former to provide colored images.

U.S. Pat. No. 4,121,932 to Ishida, discloses an electrophotographic process for forming a dye image. The process comprises an electrophotographic material containing a photoconductive layer consisting of photoconductive powders and sublimable dyes. The electrophotographic process further comprises charging a photosensitive element consisting of photoconductive particles and sublimable dyes, exposing and developing the element with acidic toners, heating the element to sublime the dyes and transferring the dye images to an accepting substrate.

SUMMARY OF THE INVENTION

In accordance with an aspect of the invention there is provided a printing machine for producing an image on a recording sheet, including means for recording an electrostatic latent image on the recording sheet; means for developing the electrostatic latent image with donor particles carrying sublimable dye marking material of a first color to form a developed image pattern on the recording sheet; means for subliming a dye image pattern conforming to the developed image pattern into the recording sheet; and a recovery system for picking up said donor material from the recording sheet.

In accordance with another aspect of the invention there is provided a printing machine for producing an image on a recording sheet, including: an ionic projection writing head for recording an electrostatic latent image the recording sheet; a developer unit having donor material carrying a sublimable dye marking particles of a first color therein for developing the electrostatic latent image on the recording sheet; a heater for subliming the developed image onto the recording sheet; and a recovery system for picking up said donor material from the recording sheet.

In accordance with another aspect of the invention there is provided a method for producing an image on a recording sheet, including the steps of: recording an electrostatic latent image on the recording sheet; developing the electrostatic latent image with donor material carrying a sublimable dye of a first color to form a developed image on the recording sheet; and subliming dye from the developed image into the recording sheet.

An advantageous effect of the present invention is that the quantity of dye materials and donor material used is proportional to the actual coloration required rather than the full-page quantity of dyes consumed per print as in the Dye Diffusion Thermal Transfer process. Also, the particulate nature of donor particles and recovery thereof will scramble the mirror image thereby resolving any security issues.

These and other aspects of the invention will become apparent from the following description used to illustrate a preferred embodiment of the invention read in conjunction with the accompanying drawings.

While the present invention is described primarily in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DESCRIPTION OF THE PREFERRED EMBODIMENT

Figure 1:
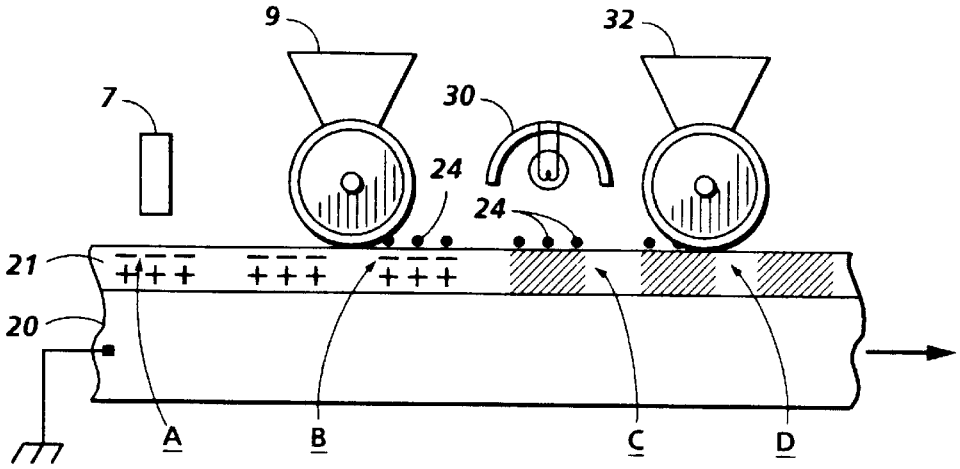
FIG. 1 schematically illustrates various processing stages which are employed to carry the color imaging process of the present invention.

For a general understanding of the dye diffusion xerographic imaging process which forms the basis of the present invention, reference is made to the drawings. In the drawings, like reference numerals have been used throughout to designate identical elements. FIG. 1 shows the various processing stages which would be employed to carry out the color imaging process of the present invention. Generally, receiving sheet 20 is the primary element of the imaging system. When transported in the direction represented by arrow 22, the sheet will pass through four stages: A) image deposition; B) development with donor particles; C) dye sublimation; and D) donor particle removal.

In the imaging process, a sheet 20 is first advanced to image deposition stage A. Numerous alternative marking processes may be utilized to create latent electrostatic images on the surface of sheet 20 within deposition stage A. An electrostatic latent image is first deposited on the surface of a sheet such as a photoconductive sheet, like a ZnO sheet, and subsequently developed, at stage B, with donor particles which contact the charged surface. Examples of marking processes include: basic xerographic techniques commonly known to employ photoconductive members which dissipate charge in response to light images; electrographic or ionographic techniques such as those described by Maczuszenko et al. in U.S. Pat. No. 4,619,515 or by Gundlach et al. in U.S. Pat. No. 4,463,363 hereby incorporate. by reference for its teachings. Furthermore, direct or non-interactive marking techniques may be used to deposit the donor particles 24 on the surface of sheet 20.

Irrespective of the imaging technique used at the image deposition stage, the result will be a developed image comprised of regions of donor particles, produced in response to original image data which is understood to have been an input to one of the previously described marking processes.

At stage B, The donor particles can be developed onto the surface sheet 20 in the manner similar to magnetic toner touchdown development in which a substantially uniform layer of toner comprising magnetic donor particles can be brought either closely adjacent to or into contact with the image by a donor roll, as disclosed in U.S. Pat. No. 4,777,904 to Gundlach et al. which is hereby incorporated by reference for its teachings. This donor deposition process is inherently limited in maximum to a monolayer of donor particles making this type of development process ideal because magnetic toner touchdown materials do not stack on top of each other. In addition, magnetic core materials are excellent black-body absorbers of radiant energy from source 30 thereby allowing efficient sublimation of dye materials into the of radiating energy from source 30 supporting substrate.

Subsequently at stage C, donor particles 24, present on the surface of sheet 20 are heated by radiant source 30 causing dye to sublime or diffuse from their surface into dye receptive surface 21 of sheet 20. Next, sheet 20 is advanced to a donor removal stage D. At this stage the used donor particles are removed by magnetically scavenging them off of the dyed sheet surface.

Figure 2:
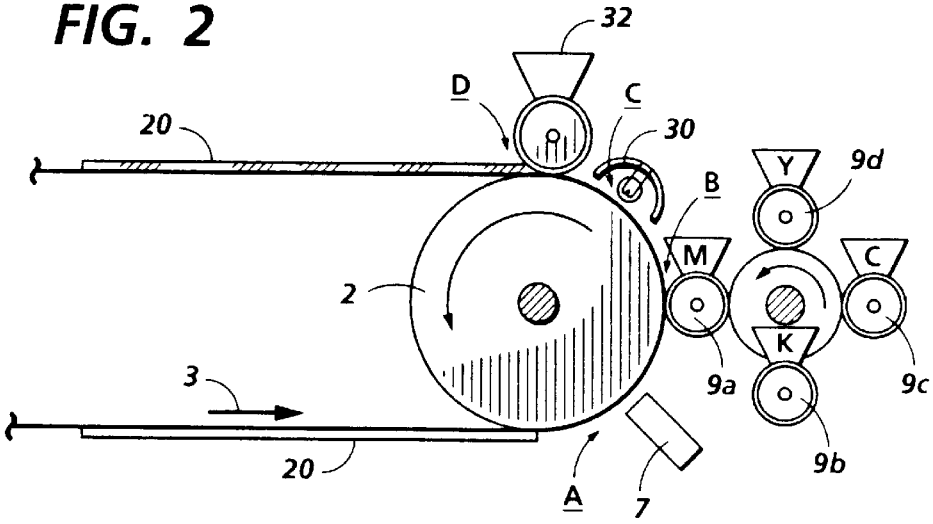
FIG 2 is a schematic representation of one possible a multicolor printing apparatus Configuration suitable for an ionographic printing process.

Illustrated in FIG. 2 is a schematic representation of one possible multicolor printing apparatus configuration suitable for an ionographic printing process. Sheet 20 is employed as an electroreceptor. A feature of electrographic paper used with the present invention is that the dielectric coating 21 not only provides the required electrical properties, but is also provides an excellent receiver material for dye sublimation marking. Plain papers such as Xerox 4024 and even the backside of Versatec electrographic paper comprise non heat-softenable cellulosic materials which merely stain with dye. The heat softenable polymer "dielectric" coating of Versatec paper exposed to the same dye and heating steps becomes vividly colored.

Sheet 20 moves around tensioning roller 2 in the direction indicated by arrow 3. Sheet 20 receives a first latent image to be developed with a first color from ionographic or ionic projection writing head 7. Ionic projection writing head 7 deposit charge onto dielectric coated paper or transparency stock. At stage B, the latent image is then developed with a first developer at one of a plurality of development stations 9*a*, 9*b*, 9*c*, and 9*d*. FIG. 2 illustrates development with station 9*a* engaged. Development stations 9*a*, 9*b*, 9*c*, and 9*d* employ a development technique limited nominally to the deposition of a monolayer of donor particles on the surface of sheet 20.

At stage C, dye is sublimed from the donor particles by heat which is applied by heat unit 30. Heating of the donor particles along with adjacent dielectric layer 21 areas results in dye diffusion into the polymer dielectric layer of the sheet.

Next at stage D, the used donor particles are magnetically scavenged back off of the dielectric layer surface by a magnetic recovery system 32. The magnetic recovery system includes a rotating magnet apparatus similar to the magnetic toner touchdown development apparatus.

When images of more than one color are desired, the sheet 20 is transported around roll 2 to again move past electrographic writing head 7, at which point another electrostatic latent image is formed on top of the first image, and that latent image moves past a second development station, where it is developed with a second donor particle of a color different from that of the first developer such as, for example, development station 9*b*. Dye from the second color donor particles sublimes into the polymer dielectric layer of sheet 20 and these donor particles are recovered by magnetic recovery system. The process is repeated, with subsequent latent images being developed at development stations 9*c* and 9*d*, until the final full color image has been formed in the surface 21 of sheet 20.

Figure 3:
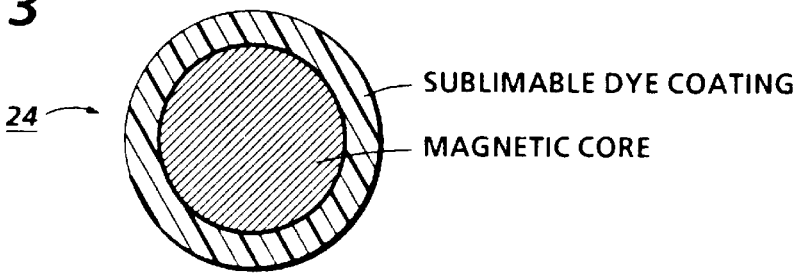
FIG 3 is a cross sectional view of a donor particle of the present invention.

Referring to FIG. 3, the donor particles of the present invention have the function of providing "Smart Donor" reservoirs of sublimable dye materials. Normally, (as in D2T2) the donor is a uniform layer of dye to which "Smart heat" is applied by the thermal print head to only the image areas. By creating a pattern of donor particles according to the desired image pattern ("Smart Donor") the thermal printhead can be replaced with uniform (dumb) heating. Donor particles and sublimable dye materials are prepared by spray drying techniques or a powder coating process of the sublimable dye materials onto their surface. The donor materials of the present invention comprise preferably magnetic core materials such as iron oxide. Other donor particles materials can be selected for coating with sublimable dye materials include particles that are capable of obtaining a charge. Accordingly, the donor particles can be selected so as to be of a negative polarity or of a positive polarity. Illustrative examples of donor particles that may be selected include granular zircon, granular silicon, glass, steel, nickel, iron, ferrites, like copper zinc ferrites, available from Steward Chemicals, and the like. The donor particles may include thereon known coatings like fluoropolymers, such as KYNAR®, polymethylacrylate, and the like. Examples of specific coatings that may be selected include a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Patents 3,467,634 and 3,526,533, the disclosures of which are totally incorporated herein by reference; polytetrafluoroethylene, fluorine containing polyacrylates, and polymethacrylates; copolymers of vinyl chloride, and trichlorofluoroethylene; and other known coatings.

Any suitable dye which either sublimes, vaporizes and/or diffuses between particles may be used in the processes of this invention. Dye material such as materials disclosed in U.S. Pat. No. 5,366,836 which is hereby incorporated by reference is preferred. However, it is preferable that the dye is sublimable, and that it sublimes at a suitably low temperature. When the dye transfer occurs by diffusion, the particles generally contact one another. Dye transfer caused by diffusion can be enhanced by subjecting the doner particles to high pressure.

Various classes of dyes including, for example, azo, anthraquinone, indophenol, indoaniline, perinone, quinophthalone, acridine, xanthone, diazine, and oxazine dyes can be diffused into the toner particles. A partial list of such dyes useful for making the color toners of the present invention includes., for example: Eastman Fast Yellow 8GLF, Eastman Brilliant Red FFBL, Eastman Blue GBN, Eastman Polyester Orange 2RL, Eastman Polyester Yellow GLW, Eastman Polyester Dark Orange RL, Eastman Polyester Pink RL, Eastman Polyester Yellow 5GLS, Eastman Polyester Red 2G, Eastman Polyester Blue GP, Eastman Polyester Blue RL, Eastone Yellow R-GFD, Eastone Red B, Eastone Red R, Eastone Yellow 6GN, Eastone Orange 2R, Eastone Orange 3R, Eastone Orange GRN, Eastman Red 901, Eastman Polyester Blue 4RL, Eastman Polyester Red B-LSW, Eastman Turquoise 4G, Eastman Polyester Blue BN-LSW, (all available from the Eastman Kodak Co., Rochester, N.Y.). Other dyes useful in the process of making and using this invention include magenta, ICI Disperse Red; yellow, cyan, DuPont Disperse Blue 60; red, Bayer Resiren Red TB; and green, Bayer Macrolex G and the like. Additional examples of dyes which may also be suitable for use in the present invention include BASF Lurifix Blue 590, BASF Lurifix Orange, BASF Lurifix Red 380, BASF Lurifix Red 420, BASF Lurifix Yellow 150, ICI Dispersol Red B2B, ICI Dispersol Yellow BGB and ICI Dispersol Blue BN. The dye should be thermally and chemically stable, compatible with the polymers contained in the toner particles and colorfast. The dye preferably has a low specific heat of from about 1.5 to about 2 Joules per gram-degree Centigrade, and a low latent heat of fusion of from about 20 to about 150 Joules per gram. The melting points of the many of the dyes exemplified above range from about 150° to 250° C. Melting points outside these ranges can be selected providing the objectives of the present invention are achieved. Preferred dyes have a specific heat of about 1.8 Joules per gram-degree Centigrade and have a latent heat of fusion between 30 and 120 Joules per gram. All of these dyes sublime easily and are expected to be uniformly imbibed when deposited upon donor particles. Some of the dyes described above are also disclosed in U.S. Pat. No. 4,081,277 to Brault, the entire disclosure of which is incorporated herein by reference. Advantageous features of the present invention is that the donor particles carrying dye are dry to the touch and the donor particle can be employed in developer apparatus used in xerography which utilizes magnetic dry toner. In addition, no solvents are needed to render the image colored.

In summary, there has been provided an image process, or set of processes, that combine charged image pattern creation techniques of electrostatic imaging with the coloration capabilities of dye sublimation to produce novel color printing systems offering unique advantages in copy quality, costs, speed, and security. Donor particles are employed using electrostatic imaging techniques to create temporary "Smart Donor" patterns. Uniform overall "Dumb Heat" is applied to sublime dyes from the "Smart Donor " patterns into the final image support member. The quantity of dye materials used is proportional to the actual coloration required rather than the full-page quantity of dyes consumed per print as in the D2T2process. Also, the particulate nature of donor particles and recovery thereof will scramble the mirror image thereby resolving any security issues.

It is, therefore, apparent that there has been provided a color printing machine in accordance with the present invention, that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A printing machine for producing an image on a recording sheet, comprising:

means for recording an electrostatic latent image onto the recording sheet;

means for developing the electrostatic latent image with dry donor particles carrying colored sublimable dye marking material of a particular color to form a developed image on the recording sheet;

means for subliming dye to form a colored image [into] on the recording sheet; and a recovery system for picking up said dry donor particles from the recording sheet.

2. The printing machine of claim 1, further comprising: means for recording another electrostatic latent image on the recording sheet; and means for developing the other latent image with dry donor particles carrying colored sublimable dye marking material of a different color to form a composite image on said recording sheet.

3. The printing machine of claim 1, wherein said recording means comprises an ionic projection writing head.

4. The printing machine of claim 1, wherein said subliming means comprises a heating unit.

5. The printing machine of claim 1, wherein said recording sheet consist essentially of paper having a dielectric coating thereon.

6. The printing machine of claim 1, wherein said developing means comprises a developer apparatus for applying dry toner particles.

7. The printing machine of claim 1, wherein said recovery system comprises a magnetic member.

8. The printing machine of claim 1, wherein said donor particles comprise magnetic core materials.

* * * * *